US005463862A

United States Patent [19]

Reisenauer

[11] Patent Number: 5,463,862

[45] Date of Patent: Nov. 7, 1995

[54] ROLLER CHAIN BREAKER

[76] Inventor: Theodore E. Reisenauer, Box 752, Tekoa, Wash. 99033

[21] Appl. No.: 408,025

[22] Filed: Mar. 21, 1995

[51] Int. Cl.[6] ..... B21L 21/00

[52] U.S. Cl. ..... 59/7; 59/11; 29/243.53; 29/243.54

[58] Field of Search ..... 59/7, 11; 29/243.53, 29/243.54

[56] References Cited

U.S. PATENT DOCUMENTS

| | | | |
|---|---|---|---|
| 3,553,960 | 9/1968 | Ellefson | 59/7 |
| 3,698,181 | 10/1972 | Paul et al. . | |
| 3,820,224 | 6/1974 | O'Callaghan . | |
| 3,826,900 | 6/1974 | Spraker . | |
| 4,063,412 | 12/1977 | Bruzek | 59/7 |
| 4,365,401 | 12/1982 | Ogren | 59/7 |
| 4,429,525 | 2/1984 | Doak . | |
| 4,512,070 | 4/1985 | Anhalt | 59/7 |
| 4,704,914 | 11/1987 | Horng | 74/411.5 |
| 4,870,739 | 10/1989 | Richards | 59/7 |
| 5,203,158 | 4/1993 | Bowers . | |
| 5,214,909 | 6/1993 | Livesay et al. | 59/7 |

FOREIGN PATENT DOCUMENTS

| | | | |
|---|---|---|---|
| 457607 | 3/1970 | Japan | 59/7 |

*Primary Examiner*—David Jones
*Attorney, Agent, or Firm*—Wells, St. John, Roberts, Gregory & Matkin

[57] ABSTRACT

A breaker for roller chains includes a rigid frame with a chain receiving opening. A clamp member with an open pin receiving bore is mounted to the rigid frame on one side of the opening for adjustment along an axis. A punch block with a central bore is releasably mounted to the rigid frame on an opposite side of the opening. The punch block is located by a positioner with its central bore substantially coaxial with the axis. The punch block and clamp member include chain link engaging surfaces positioned relative to the opening to releasably clamp a roller chain with a pin thereof aligned with the axis and with the link engaging surfaces in clamping engagement with chain side plates adjacent the pin. A punch pin is slidably mounted within the punch block central bore, with a pin driving end movable through the opening and receivable axially within the pin receiving bore of the clamp member. A headed end of the punch pin is releasably mounted to the ram shaft by a freely rotatable cleat on a saddle that is releasably mounted at the end of a ram shaft. A ram drives the ram shaft and attached punch pin to move along the axis through a prescribed axial stroke to force the pin from the chain.

10 Claims, 6 Drawing Sheets

37
36
33
12
13
10
11
12
25
42
43
15
40
48
46
II
II
63
47
61
62

ROLLER CHAIN BREAKER

TECHNICAL FIELD

The present invention relates to breaking of roller chains by removal of a pin connecting side plates of the chain.

BACKGROUND OF THE INVENTION

It is a difficult and time consuming process to break roller chain into selective lengths. This is especially true of large chains, and chains having multiple spans.

Tools have been developed in the past for application of mechanical force to drive pins from chains. Such tools are typically called chain breakers, and are hand held devices with plier-like handles for application of mechanical force to drive the pins. Such tools have limited use, especially with multiple strand chains.

As a solution to the above problem, the present inventor developed a hydraulic chain breaker that made use of a hydraulic cylinder in a rigid frame for application of hydraulic force to break chains. While the hydraulic breaker was serviceable, several problems became evident with its use.

The hydraulic chain breaker included a rigid frame with a punch block and a sliding punch pin mountable within the frame in axial alignment with the hydraulic cylinder. Headed ends of the pin sliding punch was connected to the hydraulic cylinder by means of a threaded saddle with a punch receiving cleat welded thereon.

The cleat received the headed end of a sliding punch, releasably securing the punch to the cylinder. It was found that the punch would sometimes bind in the chain when driven axially to force a pin from the chain. It then became extremely difficult to separate the punch pin and block from the cylinder in order to clear the punch pin from the chain. Separation could occur only by unscrewing the saddle from the cylinder. This was found to be a slow and difficult process. A need thus arose for a better way to releasably secure the punch to the cylinder that would permit easy access for removal of the punch if binding should occur.

It was also found that the stroke length of the cylinder was such that the cleat could be forcefully driven against the punch block and crimped, binding the punch pin head in the cleat. A need was thus realized for an arrangement whereby the cleat could be protected against such damage.

A weakness was also found in the frame of the prior breaker, in the area of an opening formed in the frame for receiving the chain. This opening must permit free access for mounting and removal of chain at any point along the chain length. However, the forces applied, especially in multiple strand and large roller chains, could reach a point where the frame could bend. A need for reinforcement of the frame in this area was thus realized.

A need also arose for shields to assure user safety in the areas where the cylinder shaft connected to the punch, and over the chain receiving opening.

The above needs are filled by the present breaker which also provides further advantages that will become apparent from the following specification, drawings, and claims.

BRIEF DESCRIPTION OF THE DRAWINGS

Preferred embodiments of the invention are described below with reference to the accompanying drawings, which are briefly described below.

FIG. 7 is a view similar to FIG. 6 only showing a different operational position of the components;

FIG. 8 is a view similar to FIG. 7 showing another operational position of the components;

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
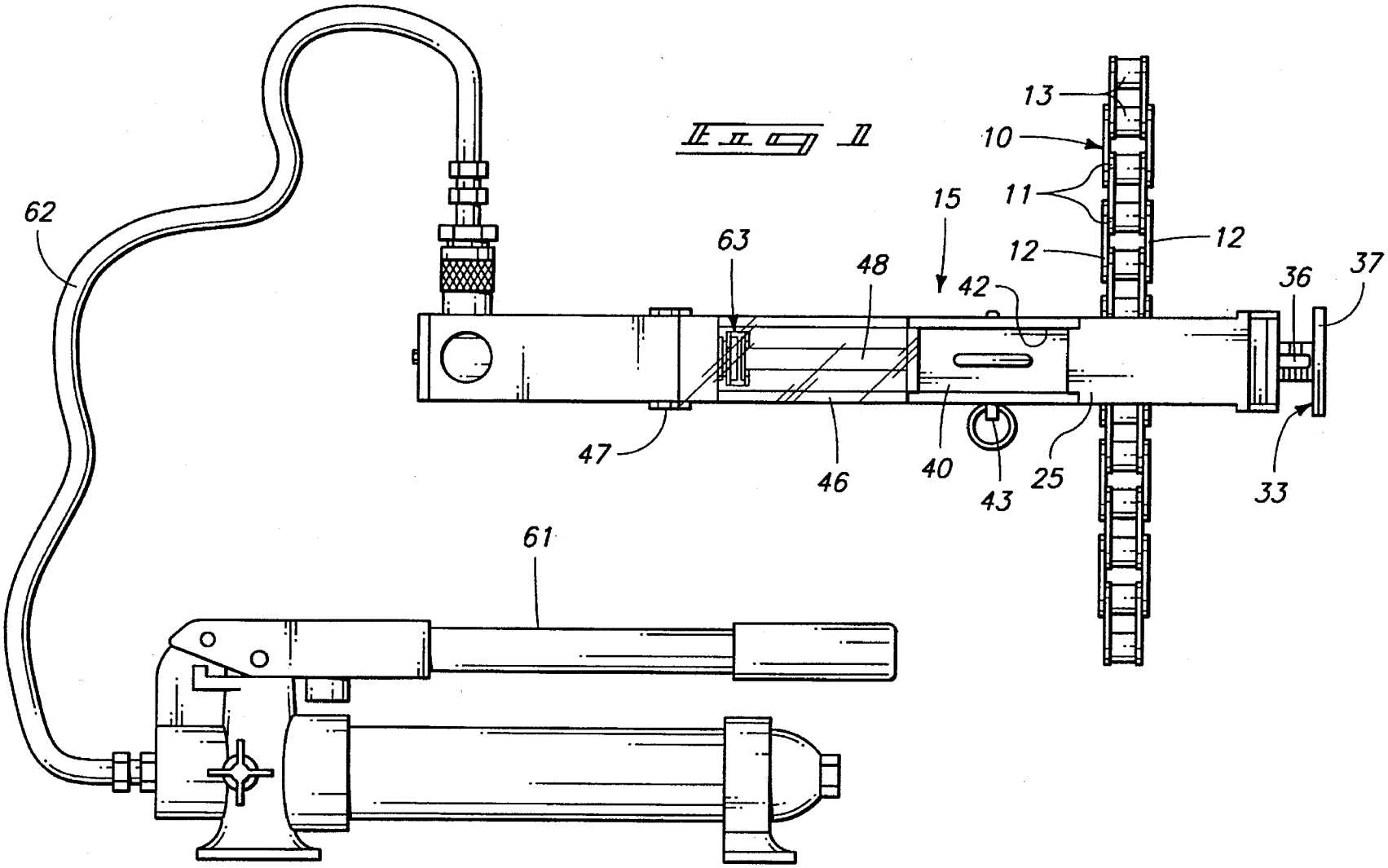
FIG. 1 is a plan view of a preferred chain breaker with a chain mounted thereto, and further showing connection to a hydraulic pump.
Figure 2:
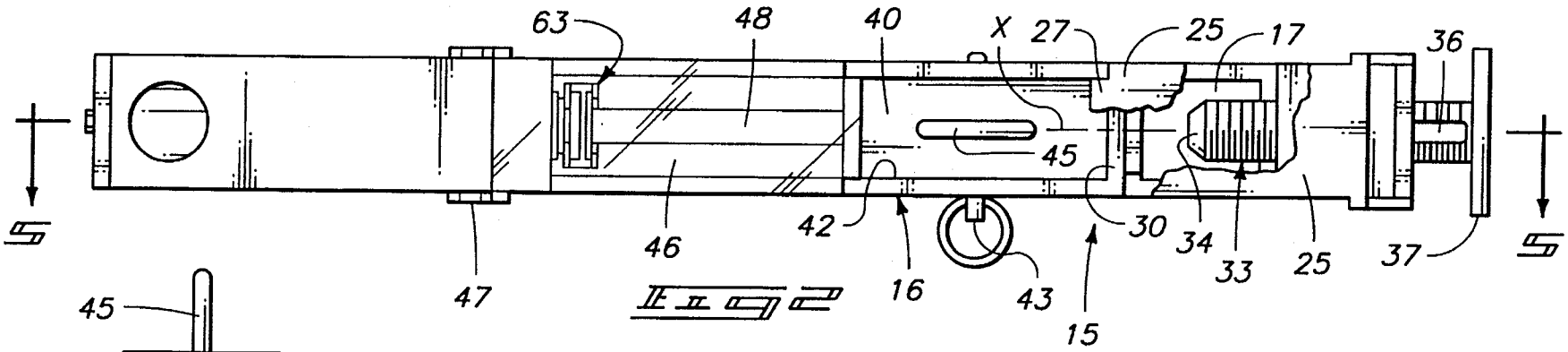
FIG. 2 is an enlarged top plan view of the presently preferred chain breaker with portions thereof broken away.
Figure 3:
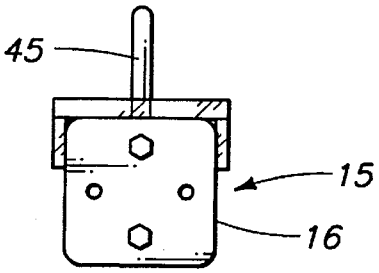
FIG. 3 is an end view as seen from the left in FIG. 2.

The present invention is intended for the purpose of breaking roller chains. A short span of one such chain is shown in FIG. 1 and in section by FIGS. 6–8. The chain is generally designated by the reference numeral 10. It is made up of multiple links 11 formed of side plates 12 joined by roller pins 13. Such chains are broken by removing any one of the pins 13 from the strand, thus separating the strand into two sections.

To break the chain, the selected pin 13 must be driven axially from between its adjacent side plates 12. The present breaker 15 is provided to quickly and safely accomplish this task. Further, the present breaker 15 will function to break chains of different size, pitch, and strand numbers with minimal adjustment.

Looking to the drawings in greater detail, the presently preferred chain breaker 15 is shown to include a rigid frame 16. The frame 16 is elongated and, in the preferred form shown, is generally tubular in construction and is formed of steel. It includes a chain receiving opening 17 that includes sufficient axial dimension along the length of the frame 16 to receive chains of different size and strand numbers.

Figure 4:
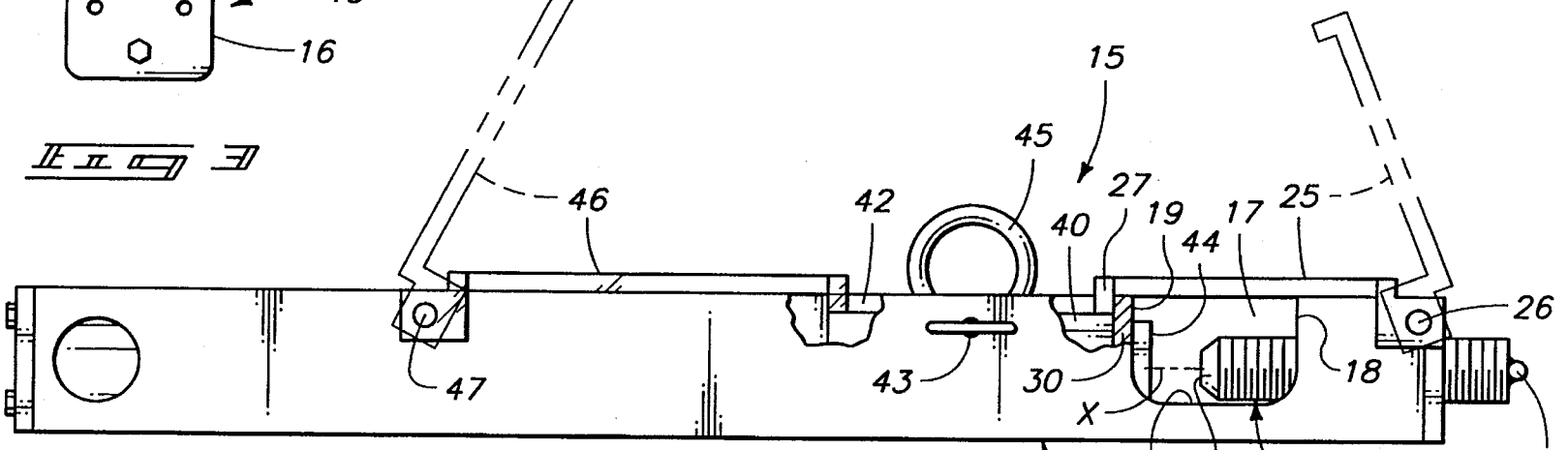
FIG. 4 is a side elevation view.
Figure 5:
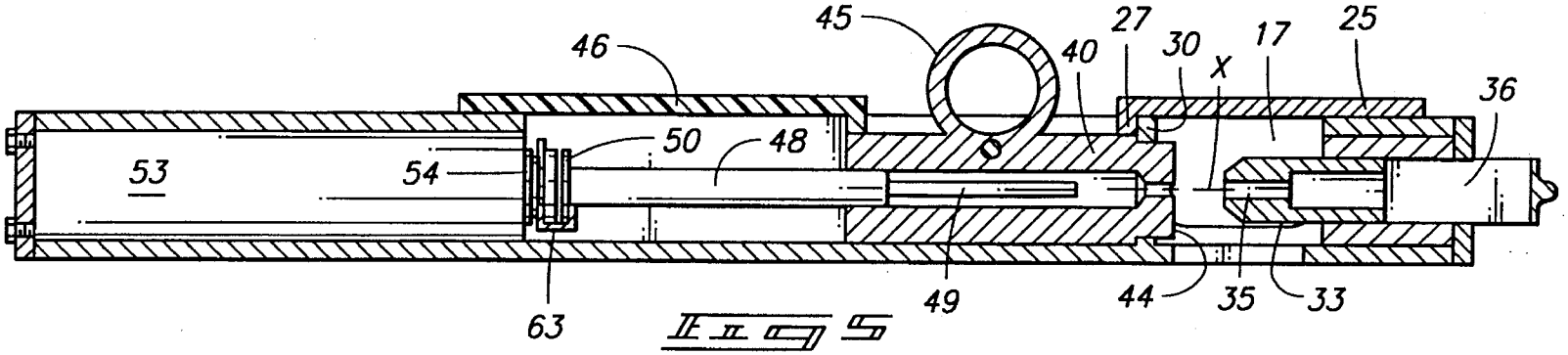
FIG. 5 is a sectional view taken along line 5—5 in FIG. 2.

The opening 17 is defined by opposed first and second sides 18, 19 and a bottom 20 (FIG. 4). The opening 17 extends to the top of the frame to permit insertion and removal of chain regardless of chain length.

In the preferred form, a movable cover 25 is provided to span the chain receiving opening 17. The preferred cover 25 includes an end that is hinged at 26 to the frame. The cover is thus pivotable between an open position (as shown by dashed lines in FIG. 4) to allow access to the chain receiving opening, and a closed position (as shown by solid lines in FIG. 4) spanning the chain receiving opening 17. The preferred cover is formed of steel.

A lip 27 is advantageously provided on the cover, engageable with a stop surface 30 on the frame 16 to axially secure the cover on the frame in the closed position. The lip 27 interlocks with the stop surface 30. The closed cover 25 will thus axially reinforce the frame across the chain receiving opening and prevent the frame from bending at the opening when under stress during operation. The cover 25 also provides a measure of safety, covering the opening 17 and chain section within the opening during use.

A clamp member 33 (FIGS. 1–8 and 11) is mounted to the rigid frame 16 toward the first side 18 of the chain receiving opening 17. The clamp member is adjustable along an axis X along the frame. Such adjustment is facilitated in the preferred form exemplified herein, by threadable engagement between the clamp 33 and frame 16 along the axis X. The preferred form of clamp member 33 may thus be alternatively described as a thumb screw.

An inward, formed end 34 of the clamp member 33 is of a frusto-conical configuration, leading to a flat end surface for engagement with chain side plates 12. The frusto-conical form adapts the clamp member 33 to different size chains 10 by minimizing the contact area against the chain side plates.

Clamp member 33 also includes an open pin receiving bore 35 positioned substantially coaxially with the axis X. The bore 35 is centered on the end 34, and extends axially to a transverse open slot 36 (FIGS. 1, 2, 5–8, and 11) which is provided to discharge removed pins 13 (FIG. 8) during operation.

The clamp member 33 further includes oppositely projecting laterally extending wing levers 37. Such levers provide mechanical advantage and easy hand access for turning the clamp member 33.

A punch block 40 is releasably mounted to the rigid frame on the second side 19 of the opening. The block is solid except for an elongated open ended central bore 41 formed along its length. Preferably, any one of several interchangeable blocks 40 may be selected (FIGS. 12–15) with different size bores 41 to receive different size punch pins 48 (described below).

The punch block 40 is shaped to be received within an access opening 42 formed in the frame 16, and against the stop surface 30. A positioner 43 on the frame releasably locates the punch block in position with the central bore 41 substantially coaxial with the axis X. As shown, the positioner 43 is provided as a pin, extending through aligned holes in the frame and punch block when the punch block is in proper position.

Figure 6:
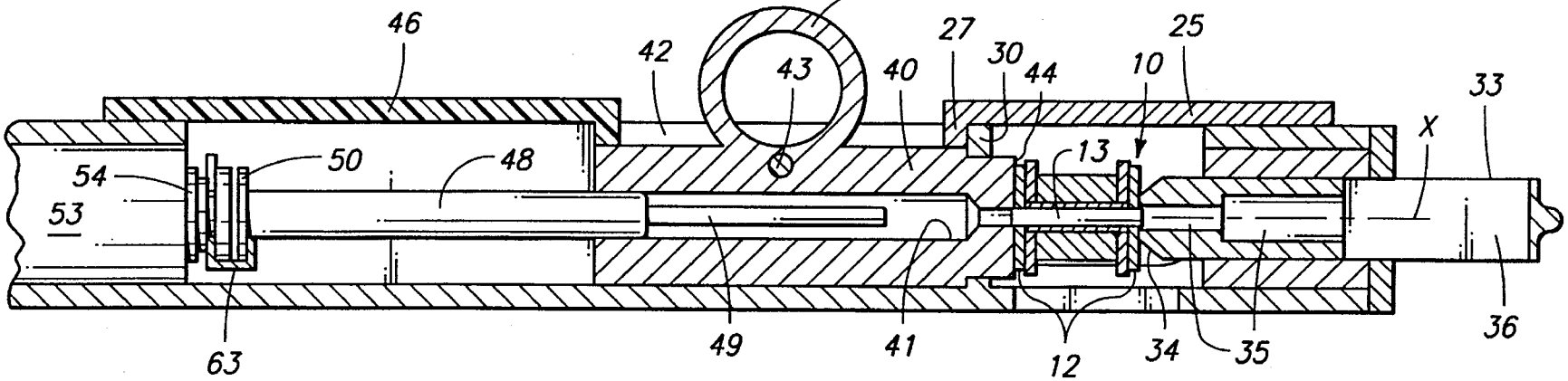
FIG. 6 is an enlarged fragmented sectional view on the same plane as shown in FIG. 5 with a chain shown in section therein.
Figure 11:
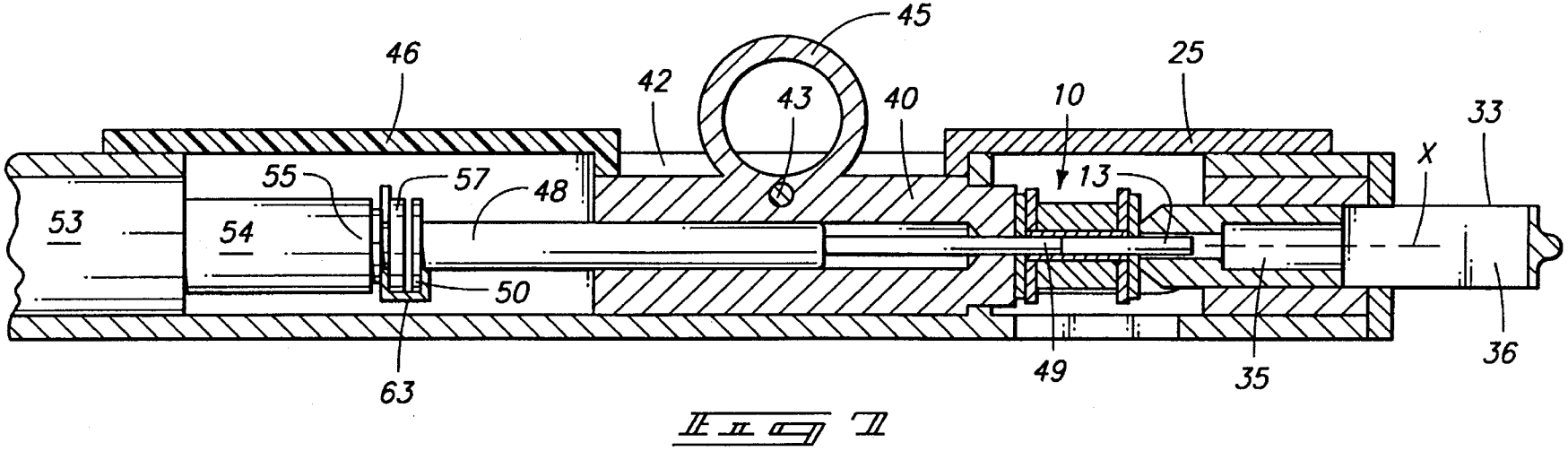
FIG. 11 is a perspective sectioned view of a clamp member of a presently preferred form.
Figure 12:
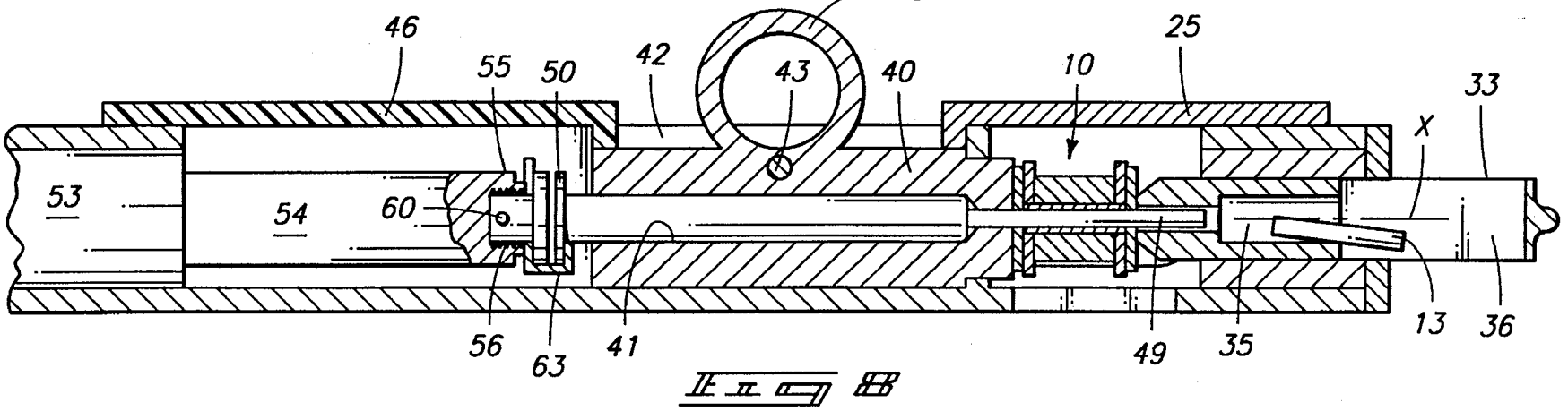
FIGS. 12–15 are end views of different punch blocks showing various pin punch sizes useful with the present breaker.

The punch block also includes a clamp surface 44 that is positioned opposite the clamp member 33, projecting into the opening 17 to engage side plates of a chain received within the opening 17 (FIGS. 6–8). The clamp surface 44 is dimensioned to engage only one selected side plate on a chain strand, adjacent the pin 13 to be removed.

A handle 45 is provided on a top surface of the punch block to enable mounting and removal of the punch block 40 to and from the frame. The handle 45 projects above the frame as shown in FIG. 4.

A movable viewing window 46 is provided in a preferred form of the present breaker 15, for selectively covering the access opening 42. The window 46 is hinged at 47 to the frame, and extends along an axial dimension of the frame. The window 46 is preferably transparent, formed of a transparent plastic such as clear acrylic or similar material.

A punch pin 48 is slidably received within the central bore 41 of the punch block 40. The pin includes a pin driving end 49 movable through the opening 17. The driving end 49 is of sufficient length to be extended through the opening 17 from the punch block 40, and be received within the pin receiving bore 35 of the clamp member 33.

The size of the driving end (in cross-section) is similar to that of the pins 13 intended to be driven from the chain. Thus, different punch pins 48 are provided, along with the various size punch blocks shown in FIGS. 12–15.

Each of the punch pins also includes a headed end 50 that projects axially from the punch block. The head 50 is integral with the punch pin, and forms a shoulder to facilitate releasable mounting to a ram 53 as next described.

The ram 53 is mounted to the frame and includes a ram shaft 54 selectively driven to move along the axis X through a prescribed stroke toward and away from the chain opening 17. In the preferred form, the ram is provided as a hydraulic cylinder. However it is conceivable that other fluid or mechanical apparatus might be used. For example, a machine screw jack, rack and pinion, ratchet jack-type mechanism, toggle jack, or air cylinder, could also be used to forcefully and linearly move the ram shaft along the axis X. The term "ram" should thus be broadly construed in consideration of the above alternatives.

In the preferred example shown, the ram is selected as a hydraulic cylinder, mounted within the frame 16 and connected to a remote pump 61 by means of a hose 62. The hose 62 is connected to the cylinder through any one of several access openings formed in the frame 16. Several openings are provided to enable selective positioning of the hose in relation to the frame, depending upon the desire of the user. Likewise, the frame provides several alternative cylinder mounting positions denoted by the mounting holes shown in FIG. 3, to allow the user selection of positions when mounting the cylinder base.

In the preferred form of the present breaker, the cylinder and shaft are conventional, available through Dayton Electric Mfg. Co., 5959 W. Howard St. Chicago Ill. 60648. Most preferred is Dayton's model "4Z483" as it includes a desired prescribed stroke length, and an internal return spring for automatically returning the shaft 54 thereof to a retracted position from its fully extended position. The pump and hose are also conventional and readily available on the marketplace.

The shaft 54 of the ram extends along the axis X to an end 55 facing the headed end of the punch pin 48. The end 55 includes a socket 56 (FIG. 8) for releasably receiving a saddle 57. The releasable interconnection between the saddle 57 and socket 56 is noteworthy.

Figure 9:
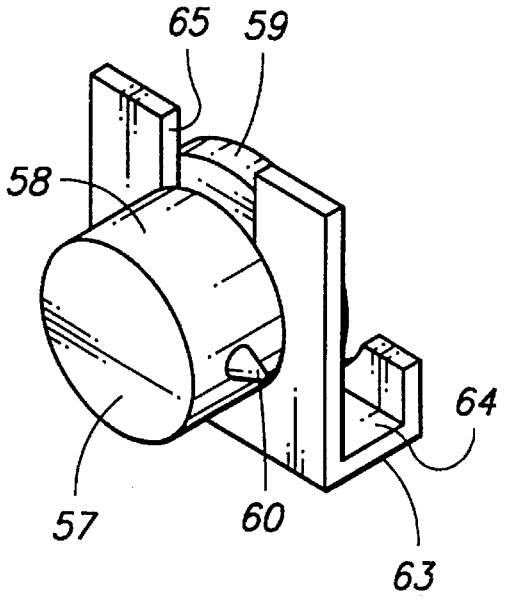
FIG. 9 is an enlarged perspective view of a saddle and cleat of a present preferred form.
Figure 10:
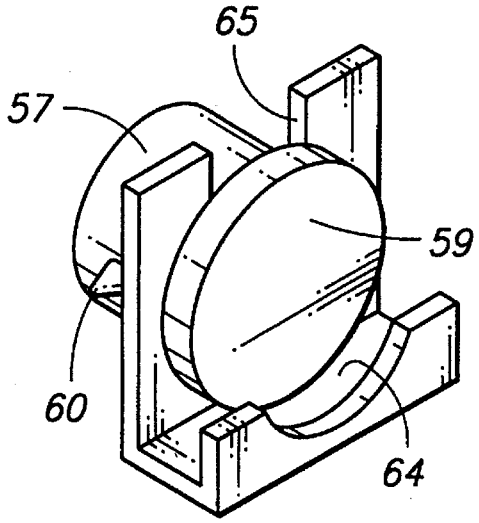
FIG. 10 is a perspective view showing the saddle and cleat from a different angle.
Figure 11:
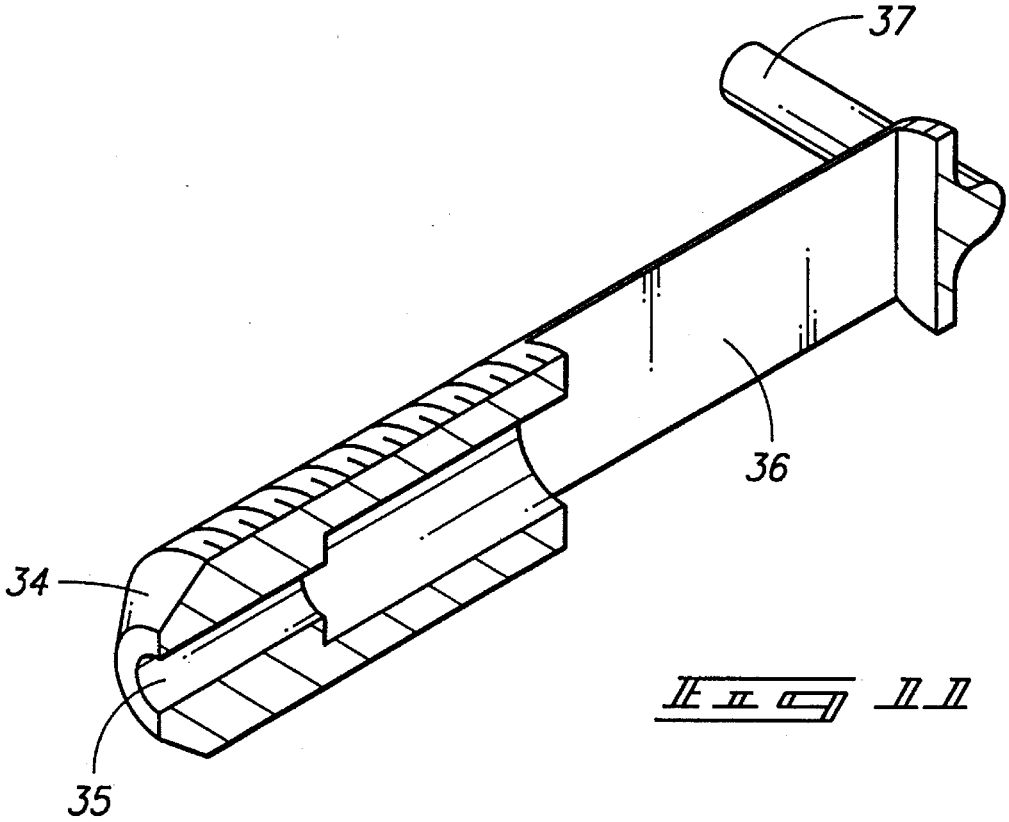
Figure 12:
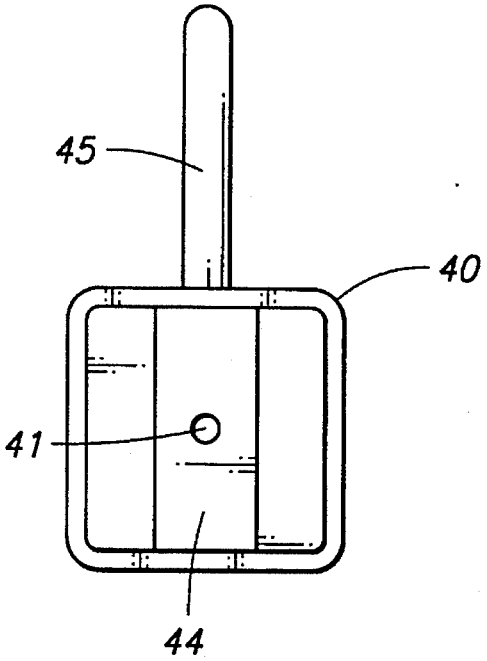
Figure 13:
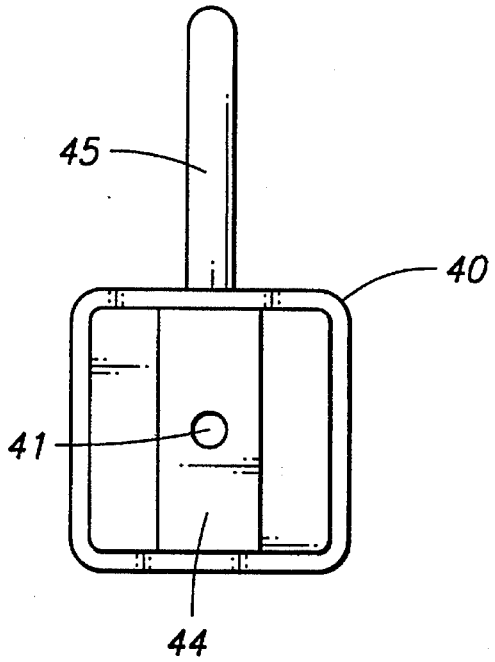
Figure 14:
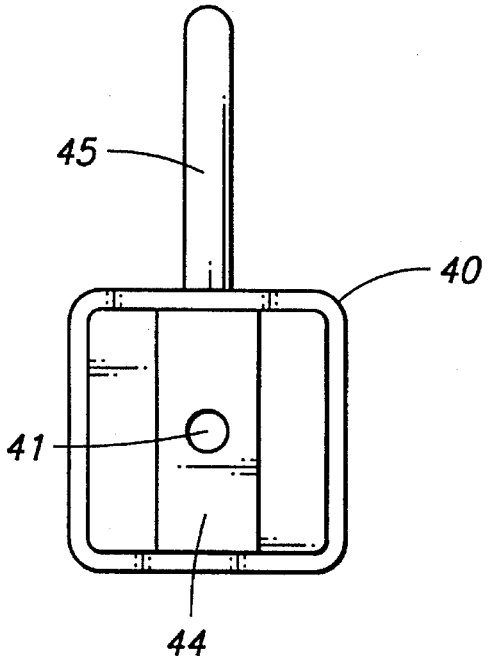
Figure 15:
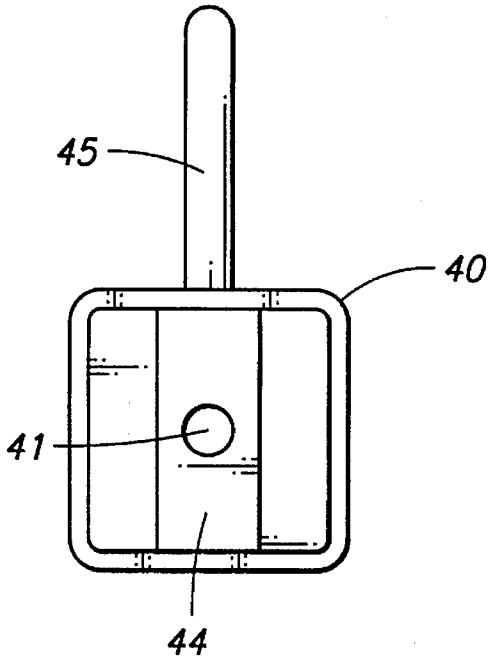

The saddle includes a shank 58 that is slidably received in the socket 56 (FIGS. 8–10), and a headed end 59. The socket 56 is provided with a pointed, spring biased detent 60 that engages threads formed in the socket. On insertion, the saddle is simply slid axially into the socket. The detent snaps over the threads as the saddle is inserted, releasably holding the saddle in axial position in the socket. Retraction of the saddle involves a similar but opposite action. The saddle is simply pulled axially with sufficient force to release the detent, which then simply snaps back over the threads until the saddle is released. No turning of the saddle is thus required to attach or release the saddle from the socket, yet the saddle is relatively free to rotate within the socket.

A cleat 63 is mounted to the saddle 57 for relatively free rotation about the axis X in relation to the saddle 57. The cleat 63, preferably formed of rigid steel or similar material, includes a first laterally open recess 64 for releasably receiving the headed end of the punch pin 48, thereby connecting the punch pin to the ram for axial movement along the stroke of the ram.

The cleat 63 also includes a second laterally open recess 65 for releasably receiving the shank part 58 of the saddle 57 adjacent the head 59. The cleat 63 thus releasably mounts the headed end of the punch pin 48 in axial alignment with the ram shaft 54, for movement responsive to extension and retraction of the ram. The cleat 63 is rotatable on the axis X independently of the shaft 54 or punch pin 48, to enable separation of the punch pin 48. This is done so the recesses 64, 65 may be maintained in, or be easily turned to, upwardly open orientations at all times. This permits separation of the punch pin 48 and punch block 40 from the breaker simply by removing the positioner 43, and lifting the punch block 40 (and the punch pin carried in the block) from the frame 16.

A dimension along the frame between the punch block and the ram is selected carefully in consideration of the stroke length of the ram. The dimension is selected to be slightly greater (approximately ⅛ inch in one preferred form) than the stroke length. Thus there is no way that the ram can be inadvertently operated to drive the cleat 63 against the punch block 40.

Given the above description, operation of the present invention may now be understood. Operation will be discussed in specific terms to the preferred example illustrated in the drawings, in use for breaking a single strand chain. Similar steps would be used for breaking other chain sizes, and multiple strand chains.

Prior to operation, the user determines the size of the chain to be broken. A similarly sized punch block and punch pin are then selected and mounted to the frame 16. This is done simply by dropping the punch block (and the pin carried therein) into the access opening, and securing it in position using the positioner 43. The headed end 50 of the punch pin is similarly dropped into place within the cleat 63. The breaker is now ready for use.

As a first step in operation, the user lifts the cover 25, to gain access to the chain receiving opening 17. The selected links of the chain are then lowered into the opening, with the pin to be removed in alignment with the bore 35 of the clamp member 33, and the bore 41 of the punch block. The clamp is then tightened, using the wing levers to turn the clamp, threading the clamp closed against the adjacent side plate of the chain. The chain is now secured with the enclosed pin in alignment with the punch pin 48 and pin receiving bore 35 of the clamp. The chain side plates are securely held between the clamping surface 44 and the formed end 34 of the clamp member 33.

Next, the cover 25 is closed, covering the clamped part of the chain and engaging the lip 27 with the stop surface 30, reinforcing the frame against the strain about to be produced as the ram is operated. Operation of the ram, in the embodiment shown, is accomplished by operating the pump 61. Hydraulic fluid from the pump 61 is forced into the cylinder (ram) to drive the shaft 54 outwardly with great force (according to the operating tonnage of ram). The ram acts against the frame to extend the shaft, and to move the attached punch pin through the bore 41 against the pin 13. Continued operation of the ram forces the pin 13 axially from between the chain side plates and into the clamp bore 35, where it finally drops through the slot 36. The chain is now broken.

The pump may be operated at this point (by appropriate conventional valving) to allow the ram to retract. The internal retraction spring in the cylinder will cause the shaft 54 to retract, pulling the punch pin back through the chain side plates clear of the chain. Now the clamp member 33 can be loosened by turning the wing levers, unclamping the chain side plates. The cover 25 may now be lifted, exposing the broken chain ends, and allowing the separated chain sections to be removed from the breaker.

Should the punch pin bind in the chain as the ram is retracted, the punch block, bound punch pin, and chain can be easily removed from the frame simply by removing the positioner pin 43 and lifting the assembly from the frame. The relatively freely rotatable cleat 63 facilitates such removal, as it may be easily turned so the recess 64 faces upwardly to allow separation of the pin punch from the cylinder shaft. The sliding relationship between the saddle 57 and shaft socket also facilitates such removal, by enabling separation of the saddle and cleat from the cylinder shaft simply by gently prying the saddle axially from the shaft end. The spring biased detent 60 will permit the saddle to snap from engagement with the shaft, thus fleeing the shaft to return to its retracted position and allowing the punch block, punch pin, and chain to be removed from the frame.

The steps outlined above can be performed quickly and in safety, for nearly any normal size roller chain, whether it be single strand or multiple strand.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A breaker for roller chains having multiple links formed of side plates joined by roller pins, comprising:

a rigid frame including a chain receiving opening defined therein between opposed first and second side;

a clamp member mounted to the rigid frame on the first side of the opening, for adjustment along an axis and including an open pin receiving bore positioned substantially coaxially with said axis;

a punch block releasably mounted to the rigid frame on the second side of the opening and defining an elongated open ended central bore;

a positioner on the frame releasably locating the punch block in position on the rigid frame with the central bore substantially coaxial with said axis;

wherein the punch block and clamp member include chain link engaging surfaces positioned relative to the opening to releasably receive a roller chain with a pin thereof aligned with said axis and with the link engaging surfaces in clamping engagement with chain side plates adjacent the pin;

a pin punch slidably received within the central bore of the punch block, having (a) a pin driving end movable through the opening and receivable axially within the pin receiving bore, and (b) a headed end;

a ram mounted to the frame and including a ram shaft selectively driven by the ram to move along said axis through a prescribed stroke toward and away from the-chain opening;

the ram shaft including an end having an axial socket substantially centered on said axis;

a saddle including a head and shank part, with the shank part being releasably received within the axial socket and the head projecting axially toward the chain opening;

a detent releasably securing the saddle axially within the socket and for permitting removal of the saddle from the socket without requiring rotation of the saddle relative to the ram shaft;

a cleat mounted to the saddle for relatively free rotation about said axis in relation to the saddle, and including a first laterally open recess for releasably receiving the headed end of the punch pin, thereby connecting the pin driver to the ram for axial movement along said stroke; and wherein the ram is selectively operable to drive the punch pin through the chain opening along the axis to force the chain pin positioned between the punch block and clamp member axially into the pin receiving bore of the clamp member.

2. A breaker for roller chains as claimed by claim 1, wherein the ram is axially positioned in relation to the punch block by a distance greater than the prescribed stroke of the ram.

3. A breaker for roller chains as claimed by claim 1, further comprising a movable cover spanning the chain receiving opening.

4. A breaker for roller chains as claimed by claim 1, further comprising:

a cover having an end hinged to the frame and pivotable between an open position allowing access to the chain receiving opening and a closed position spanning the chain receiving opening; and a lip on the cover, engageable with the frame to axially secure the cover on the frame in the closed position and axially reinforce the frame across the chain receiving opening.

5. A breaker for roller chains as claimed by claim 1, further comprising an access opening in the frame for releasably receiving the punch block; and a movable viewing window selectively covering the access opening.

6. A breaker for roller chains as claimed by claim 1 wherein the clamp member is a thumb screw threadably engaged with the frame and having opposed laterally extending wing levers.

7. A breaker for roller chains as claimed by claim 1, further comprising:

a movable cover spanning the chain receiving opening;

an access opening in the frame for releasably receiving the punch block; and a movable viewing window selectively covering the access opening.

8. A breaker for roller chains as claimed by claim 1 wherein the cleat includes a second laterally open recess for releasably receiving the shank part of the saddle adjacent the head.

9. A breaker for roller chains having multiple links formed of side plates joined by roller pins, comprising:

a rigid frame including a chain receiving opening defined therein between opposed first and second side;

a movable cover spanning the chain receiving opening;

a clamp member mounted to the rigid frame on the first side of the opening, for adjustment along an axis and including an open pin receiving bore positioned substantially coaxially with said axis;

a punch block releasably mounted to the rigid frame on the second side of the opening and defining an elongated open ended central bore;

an access opening in the frame for releasably receiving the punch block;

a movable viewing window selectively covering the access opening;

a positioner on the frame releasably locating the punch block within the access opening in position on the rigid frame with the central bore substantially coaxial with said axis;

wherein the punch block and clamp member include chain link engaging surfaces positioned relative to the opening to releasably receive a roller chain with a pin thereof aligned with said axis and with the link engaging surfaces in clamping engagement with chain side plates adjacent the pin;

a punch pin slidably received within the central bore of the punch block, having (a) a pin driving end movable through the opening and receivable axially within the pin receiving bore, and (b) a headed end;

a ram mounted to the frame and including a ram shaft extending to an end, selectively driven by the ram to move along said axis through a prescribed stroke toward and away from the chain opening;

a saddle including a head and shank part mounted to the shank at the end thereof;

a cleat mounted to the saddle for receiving the headed end of the punch pin, thereby connecting the punch pin to the ram for axial movement along said stroke; and wherein the ram is selectively operable to drive the punch pin through the chain opening along the axis to force the chain pin positioned between the punch block and clamp member axially into the pin receiving bore of the clamp member.

10. A breaker for roller chains having multiple links formed of side plates joined by roller pins, comprising:

a rigid frame including a chain receiving opening defined therein between opposed first and second side;

a clamp member mounted to the rigid frame on the first side of the opening, for adjustment along an axis and including an open pin receiving bore positioned substantially coaxially with said axis;

a punch block releasably mounted to the rigid frame on the second side of the opening and defining an elongated open ended central bore;

a positioner on the frame releasably locating the punch block in position on the rigid frame with the central bore substantially coaxial with said axis;

wherein the punch block and clamp member include chain link engaging surfaces positioned relative to the opening to releasably receive a roller chain with a pin thereof aligned with said axis and with the link engaging surfaces in clamping engagement with chain side plates adjacent the pin;

a punch pin slidably received within the central bore of the punch block, having (a) a pin driving end movable through the opening and receivable axially within the pin receiving bore, and (b) a headed end;

a ram mounted to the frame and including a ram shaft selectively driven by the ram to move along said axis through a prescribed stroke toward and away from the chain opening;

wherein the ram is axially positioned in relation to the punch block by a distance greater than the prescribed stroke of the ram;

a saddle on the ram;

a cleat mounted to the saddle, and including a first laterally open recess for releasably receiving the headed end of the punch pin, connecting the punch pin to the ram shaft for axial movement along said stroke;

and wherein the ram is selectively operable to drive the punch pin through the chain opening along the axis to force the chain pin positioned between the punch block and clamp member axially into the pin receiving bore of the clamp member.

* * * * *